United States Patent [19]

Almqvist

[11] 3,944,802

[45] Mar. 16, 1976

[54] DEVICE FOR SUPPORTING ELONGATED LIGHT FIXTURES ON DRAWING BOARDS

[76] Inventor: Arne Gustav Edvard Almqvist, Grevegatan 115, S-216 22 Malmo, Sweden

[22] Filed: Oct. 15, 1973

[21] Appl. No.: 406,363

[30] Foreign Application Priority Data

Oct. 16, 1972 Sweden ..... 13301/72

[52] U.S. Cl. ..... 240/2 D; 240/73 BJ

[51] Int. Cl.[2] ..... F21V 33/00

[58] Field of Search .... 240/2 D, 4, 52, 73 R, 73 BJ, 240/73 BA, 73 JC, 73 DA, 67, 68, 69, 70, 4.1; 248/280, 281, 291, 292, 293, 298

[56] References Cited

UNITED STATES PATENTS

| | | | |
|---|---|---|---|
| 391,122 | 10/1888 | Coursen | 240/4.2 |
| 1,739,320 | 12/1929 | Lloyd | 240/4 |
| 2,131,708 | 9/1938 | Lesperance | 240/2 D |
| 2,151,259 | 3/1939 | Young | 240/4 |
| 2,289,471 | 7/1942 | Welter et al. | 240/4 |
| 2,457,752 | 12/1948 | Travis | 240/4 |
| 3,108,751 | 10/1963 | Rodmaker et al. | 240/52 R X |
| 3,110,446 | 11/1963 | Rathbun | 240/73 BA |

FOREIGN PATENTS OR APPLICATIONS

| | | | |
|---|---|---|---|
| 283,905 | 10/1952 | Switzerland | 240/2 D |
| 127,928 | 4/1950 | Sweden | 240/2 D |
| 676,056 | 5/1939 | Germany | 240/2 D |
| 1,263,426 | 5/1961 | France | 240/4 |

*Primary Examiner*—L. T. Hix
*Assistant Examiner*—Alan Mathews
*Attorney, Agent, or Firm*—John J. Dennemeyer

[57] ABSTRACT

A device for supporting an elongated light fixture on a drawing board mounted for pivoting and sliding movement on the support arm of a bracket by means of spaced bearings secured to the fixture. The bracket is mounted on the back side of the drawing board to effect the required movements for selectively positioning the support arm with the light fixture relative to the work surface of the drawing board.

8 Claims, 4 Drawing Figures

DEVICE FOR SUPPORTING ELONGATED LIGHT FIXTURES ON DRAWING BOARDS

Figure 1:
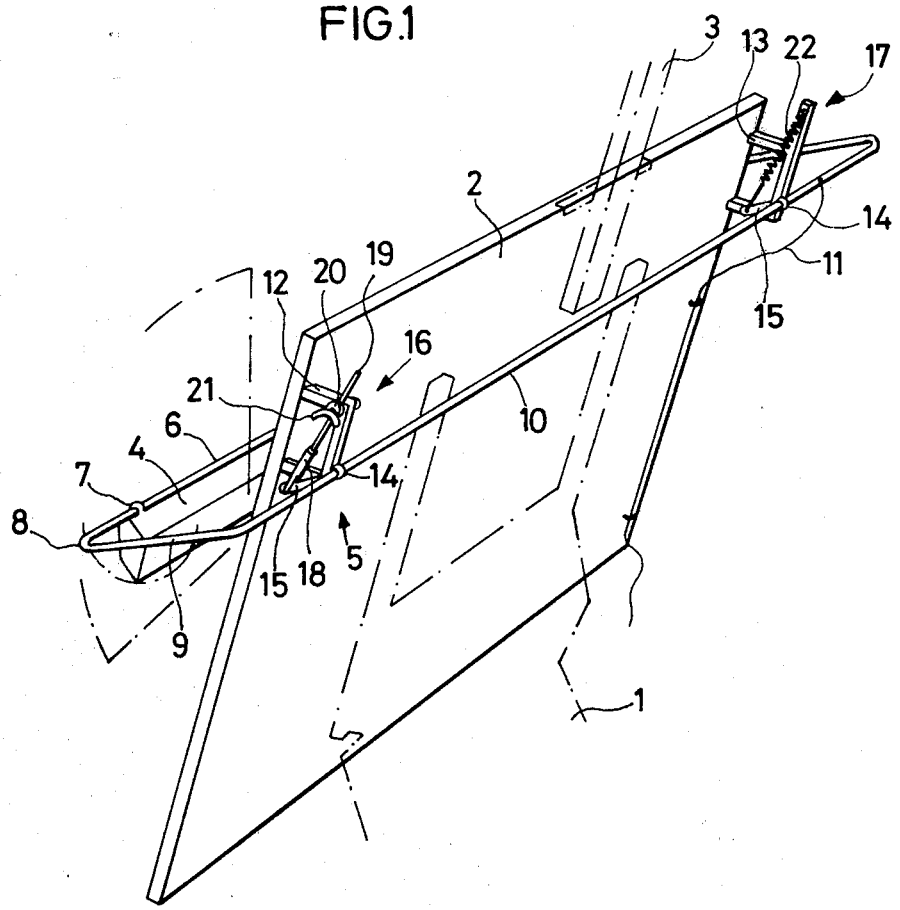

The present invention relates to a device for supporting elongated light fixtures, preferably for suspending fluorescent tube fuxtures to illuminate working surfaces, especially drawing boards or table.

In recent years the illumination problem in drawing offices has normally been solved by means of general illumination placed solely in the ceiling. Such a general illumination offers sufficient illuminating effect in working places having horizontal working surfaces and it was believed that the general illumination also offers sufficient lighting effect on oblique drawing boards.

For normal drawing work the board is set at an angle of 15°–25° to a vertical plane. As a result, all the light falling straight from above onto the working surface gives a very small illuminating effect. The best illuminating effect on the drawing board is obtained from light coming obliquely frontwards, but the lighting effect on the working surface is nevertheless insufficient since the person is placed in front of it, resulting in the formation of shadows.

As a rule, general illuminating devices also suffer from the drawback that the light intensity decreases after some months of use, since the illuminating effect of the fluorescent tubes thereof continually decreases.

For vertically oblique drawing boards the known relation that the light intensity decreases with the square of the distance is most unfavorable and the constant difference in luminous intensity between the upper and the lower part of the drawing board amounts to some hundred lux.

Furthermore, the need for lighting varies even for the same work done by the same man at different times. On the same premises there are often persons having different tasks and different lighting needs — for example a man at the age of 40 years needs twice as much light as a 20 year old man.

In order to obtain a sufficiently high illuminating effect in working premises of drawing offices having oblique drawing boards, the light intensity of the general illumination must be considerably increased for several reasons in relation to the general illumination for normal office working premises. Theoretically this is possible but leads to a corresponding increase in power consumption, whereby also the room temperature increases, resulting in ventilation problems and consequently also a risk of draught.

In view of this problem in the use of a general illumination it has become frequent practice to use local illumination on the drawing boards as a complement to the ceiling fixtures. A previously known local illumination comprises a glow lamp fixture mounted on the upper edge of the drawing board or on the carriage drawing machine of the drawing board. Such a fixture may give an adequate illuminating effect on the working surface, but only within a very restricted area, which means that the fixture must be continually moved during the progress of work. Furthermore, in case the general illumination is weak, too big a luminance difference is obtained between the visual object and the surroundings. Also, in practice it is not possible to design the light fixture socket in such a manner that a fixture mounted on the drawing board may be easily operated and at the same time displaceable over the drawing board to illuminate the whole of its surface, especially the lower half thereof. A fixture mounted on the carriage also means that the weight of the carriage is increased and it becomes difficult to handle and furthermore, the connecting cable of the fixture often obstructs the work.

It is also known already to design a local illuminating device comprising an elongated shield having a fluorescent tube mounted therein. Such a fixture is generally mounted on the stand of the drawing board by means of two arms pivotally connected to each other and pivotally connected to the stand and the fixture, respectively. The advantage of this fixture is that it enables the illumination of greater areas of the width of a big drawing board, but the known suspension including two flexible arms connected to a stand results in that the fixture may not be moved to the lower portions of the drawing board to illuminate these portions. This suspension of the fixture also results in that the links must be designed according to the weight of the fixture, with due regard thereto they must be designed for a relatively large friction so that the fixture is retained in its set position. As a result of the great frictional resistance in the links the fixture is difficult to operate and it may happen that the links fold in the wrong direction during handling. A rapid displacement of the fixture in a certain direction is thus difficult to accomplish and to facilitate the same it has been within reach to move the fixture by pushing against the same. This often results in damage to the fixture and unwillingness of the person to effectively use the same.

The object of the present invention is to obtain a device for supporting elongated local fixtures, enabling the operation of the fixture by means of simple manipulations along the drawing board and which can be utilized to illuminate the total surface of the drawing board, especially also the lower portions thereof. To accomplish this object the invention is substantially characterized in that the fixture by means of at least two bearings positioned at a distance from each other is displaceably and/or pivotally journalled on an elongated support arm directed parallel to the working surface at a distance from the same, and a bracket extends from at least one end of the arm, whereby said bracket is directed inwardly beneath the working surface and journalled on the under side thereof in a bearing permitting displacement of the bracket along the under side and/or pivotal connection of the same, so that the arm may be moved along the working surface to set or adjust the fixture at the required distance from each portion of the same.

Figure 2:
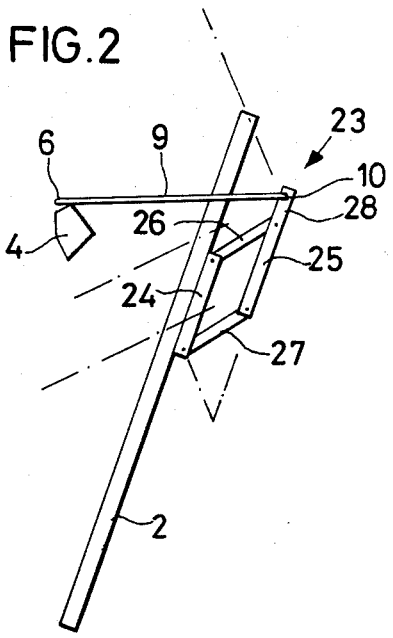
Figure 3:
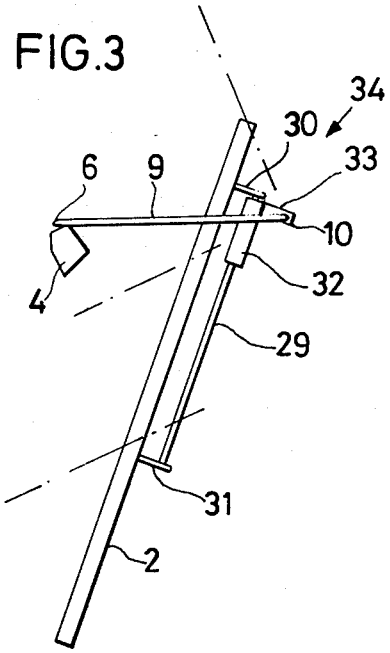
Figure 4:
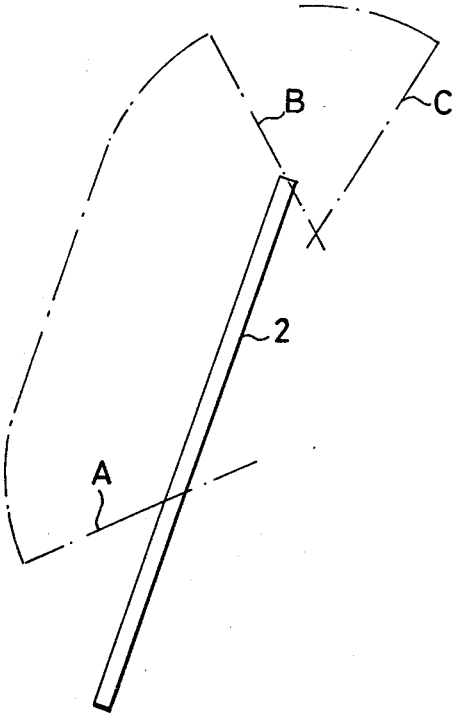

In the following the invention is described with reference to the accompanying drawings, in which:

FIG. 1 is a perspective view of a writing board provided with a device according to the invention, FIGS. 2 and 3 each illustrate a side view of two alternate embodiments of said device, and FIG. 4 illustrates a movement scheme for one of the devices.

In FIG. 1 a drawing board mechanism 1 is illustrated in dotted lines and a drawing board 2 is connected to the same having a drawing apparatus 3 of the parallelogram type and designed in a known manner. According to the invention the drawing board 2 is provided with an elongated fluorescent tube fixture 4 mounted to be set in different positions with respect to the working surface of the drawing board 2 to give the required illumination to the different portions of the same. For this purpose the fixture 4 is journalled on a fixture stand 5, generally designated by reference numeral 5, and is pivotally journalled on drawing boards having a great height, and balanced by means of balancing or equilibrium means. In the embodiment exemplified in FIG. 1 the fluorescent tube fixture 4 is journalled on an arm 6 included in the fixture stand 5 by means of two bearing sleeves 7 positioned at a distance from each other and the center of gravity thereof is preferably chosen in such a manner that it substantially takes the same angular position in relation to the working surface independent of the setting of the fixture stand 5. To obtain a stable design of the fixture stand 5 the same comprises a closed rectangular frame 8, wherein said arm 6 constitutes one long side. The short sides 9 of this frame 8 are directed past the side edges of the drawing board 2 and the second long side 10 thereof runs along the back side of the drawing board and is mounted to the same in a manner to be described hereafter. Preferably, the frame 8 is made from steel tubes and an electrical conduit 11 is placed therein to connect the fixture 4 to a wall terminal (not shown). As an alternative, however, the fixture stand 5 may comprise a separate arm (not shown), which is fixedly or pivotally mounted to at least one bracket directed past the side edge of the drawing board 2, is bent behind the drawing board and connected to the same.

To attach the fixture stand 5 to the drawing board 2 two sockets 12 and 13 are positioned at a distance from each other on the board and preferably have fixed bearing sleeves 14, and the long side 10 of the frame 8 is pivotally mounted in these. In order to balance the fixture stand 5 so that the same is retained in the set position, the long side 10 has two fixed flanges 15 which are directed radially outwardly and each flange 15 is intended to define an attachment for one end of a balancing device 16,17 generally designated by numeral 16, 17, the second end of which is positioned on the socket 12, 13. In FIG. 1 two different kinds of balancing devices are illustrated; however, preferable the same kind of balancing device is used for one and the same drawing board. The balancing device 16 shown to the left in FIG. 1 comprises a cylinder 18 flexibly attached to the flange 15. Piston 19 extends into the cylinder 18 and this device acts as a frictional brake of a kind known per se. The piston 19 extends through a hole in a bearing sleeve 20 pivotally mounted to the socket 12 and to enable setting of the piston in the bearing sleeve this is held in position by means of a screw 21. The balancing device 16 offers an adequate balancing action effect by the use of light as well as heavy fixtures, but the same may be considerably simplified. Such a simplified balancing device 17 is shown to the right in FIG. 1 and comprises a coil spring 22 hooked into a hole in the flange 15 and on a portion extending upwardly from the socket 13.

As indicated by dotted lines in FIG. 1 the fixture stand 5 may be swung through nearly 180° and by means of said journalling of the fixture 4 on the arm 6 the same retains its correct angular position in relation to the working surface during the whole swinging movement. As a result thereof the setting or adjustment may be very rapidly performed and single-handedly. Further it is possible when so required to push the fixture 4 along the arm 6, and for example, such as on long drawing boards, it may be an advantage to displaceably journal two or more fixtures 4 on said arm.

To clean the working surface it is advantageous, and for the mounting of a carriage drawing apparatus it is necessary to make possible a full swinging movement of the fixture 4 to bring it out of the way. In the embodiment illustrated above this has been made possible by positioning the fixture stand 5 on the rear side of the drawing board 2 and dimensioning the short sides 9 of the frame so that the fixture 4 may be swung upwardly over the upper edge of the drawing board 2. In order to prevent the same from impinging against the drawing apparatus 3 in such a swinging movement a stop means (not shown) is provided on the fixture 4, the arm 6 or the drawing apparatus 3.

The embodiment illustrated above is essentially intended for use with standard sized drawing boards, and for large drawing boards a somewhat differently designed journalling device for the fixture stand 5 is required. Such a device is schematically illustrated in FIG. 2 and the same comprises two link systems, generally designated by numeral 23. Each link system 23 includes four stays 24, 25, 26, 27 arranged as a parallel shaped frame and flexibly attached to each other. The stay 24 is fixedly secured to the back side of the drawing board 2 and the stay 25 directed parallel in relation thereto has an upwardly directed extension 28 provided with a hole, a bearing sleeve or the like. The long side 10 of the frame 8 is pivotally journalled in the hole or the bearing sleeve and the journalling is so designed that the same is maintained in the set angular position. The frame shaped as a parallelogram is preferably acted upon by a balancing device (not shown) to be retained in the set position. Preferably, such a balancing device is mounted between one of the stays 24 and the stay 25 and the same may conprise a frictional brake or a coil spring of the kind shown in FIG. 1 and by the insertion thereof into the frame in the mentioned manner the same will be acted upon in opposite directions on both sides of a neutral position. A journalling device designed in the manner described above permits the fixture stand 5 to be swung and to be displaced in relation to the working surface and the end positions thereof are indicated by dotted lines in FIG. 2. This means that also the lower portions of the drawing board having a great height may be illuminated in the required manner. FIG. 3 schematically illustrates an alternative embodiment especially designed to be used with drawing boards having exceptional height. In this the balancing device 34 comprises two guides 29 directed parallel to the drawing board 2 and attached to the same by means of brackets 30, 31 mounted at the ends. A sleeve 32 is slidably mounted on each guide 29, said sleeve having a flange 33 extending backwardly and provided with a hole or a special journalling device (not shown) for pivotal and in set positions fixedly secured journalling of the long side 10 of the fixture stand 5. The distance between the sleeves 32 is bridged by means of a stay (not shown) and dimensioned to hold the sleeves 32 at the same level and permit parallel displacement of the same. To balance the fixture stand 5 in the set position the sleeves 32 or the stay is acted upon by weights, springs or a balancing device of the type known per se. This design permits the fixture stand 5 to be pushed and pivoted along the total height of the drawing board and as a result thereof the fixture may be caused to illuminate all parts of the working surface. To clearly illustrate this fact the end positions of the fixture stand have been indicated by dotted lines in FIG. 4, wherein stand position A indicates the lower end position thereof, stand position B indicates the upper end position and stand C indicates a position in which the stand is swung away to prevent obstruction by cleaning of the working surface or mounting of the sliding carriage drawing apparatus.

The alternatives mentioned of course with suitable dimensioning of the fixture stand and the rest of the parts together with a suitably selected attachment height on the back side of the drawing board 2 may be used with small and also big drawing boards. Also, the illustrated embodiments may be used for plane or horizontal drawing boards.

By the swinging of the fixture stand 5 it may happen that the fixture 4 is no longer directed perpendicular to the working surface. This often occurs when the fixture stand 5 approaches the upper end position B in the swinging movement thereof. For this reason a rope (not shown), a stay or a similar means is connected to the fixture 4 and is coupled to the stand (not shown) of the drawing board or in the lower part of the drawing board 2. The length of this rope is so adjusted that the same normally hangs idle but is streched and turns the fixture 4 when this is continually brought closer to said end position B. Alternatively, the rope may be attached to the upper part of the drawing board 2 resulting in the fixture 4 being turned when it approaches the lower end position A.

The invention is not limited to the illustrated embodiments but may be varied within the scope of the following claims, and the parts 18, 19 of the frictional brake 16 may for example be fixedly secured to each other, and the required frictional effect is obtained by tightening the screw 21 more or less hard against the part 19. Further, it may be advantageous to design the frictional brake with a pressure gas cylinder pivotally connected to the drawing board 2 and provided with an extending piston, which passes through an end sleeve of the cylinder and the displacement movements of which in relation to the piston are adjustable by means of a screw threaded through the sleeve and which may exert selectively more or less pressure on the piston.

What is claimed is:

1. A device for supporting an elongated light fixture on an inclining drawing board comprising:

a. a bracket means adapted to be mounted on the underside of said drawing board, a bracket bearing sleeve mounted on said bracket means, a closed rectangular frame mounted in said bracket bearing sleeve and pivotal around an axis parallel to and at a distance from the underside of said drawing board, and a light fixture bearing sleeve pivotally mounted on said closed rectangular frame for pivotally mounting said elongated light fixture at a distance from and parallel to the working surface of said drawing board;

said closed rectangular frame comprising:

a first long side journalled in at least one bracket bearing sleeve mounted on said bracket means on the underside of the drawing board and extending under the working surface of said drawing board, a pair of short sides extending around opposite sides of said drawing board, and a second long side journalled in at least one light fixture bearing sleeve and extending over and across the working surface of said drawing board;

b. a balancing means operating on said first long side of said closed rectangular frame for maintaining said closed rectangular frame in a set position relative to the working surface of the drawing board and enabling the elongated light fixture to move across the working surface of said drawing board along an arc of a circle, the center of which is positioned at said distance from the underside of said drawing board;

whereby the elongated light fixture, by pivoting in only the bracket bearing sleeve and the light fixture bearing sleeve, maintains its desired angular orientation in relation to the working surface of the drawing board while the closed rectangular frame is rotated through approximately 90° thereby illuminating different portions of the total working surface of the drawing board.

2. A device according to claim 1 further comprising a flange mounted on the first long side of the closed rectangular frame, said flange being directed away from the first long side of the closed rectangular frame and perpendicular to the pivotal axis thereof and wherein the bracket bearing sleeve is fixedly secured to the underside of the drawing board by means of the bracket means and the balancing means has one end attached to the bracket means and the other end attached to said flange.

3. A device according to claim 2, wherein the balancing means comprises a friction break including a cylinder pivotally mounted on the flange, and a piston fitted within said cylinder and passing through a hole in a piston bearing sleeve, said piston bearing sleeve pivotally mounted on said bracket means and including a means for locking said piston against displacement through said hole.

4. A device according to claim 2 wherein the balancing means comprises a coil spring having one end hooked in a hole in the bracket means and the other end hooked in a hole in the flange.

5. A device according to claim 1 wherein the bracket means comprises four stays pivotally connected to each other to define a frame having the shape of a parallelogram, one of the stays being fixedly secured to the underside of the drawing board, the stay parallel thereto having a portion which extends past the pivotal point, the bracket bearing sleeve being mounted on said extended portion.

6. A device according to claim 5 wherein the balancing means is inserted between the stay fixedly secured to the underside of the drawing board and the stay parallel thereto, to be disposed in opposite directions on both sides of a neutral position.

7. A device according to claim 1 wherein the bracket means includes at least one guide disposed at a distance from and parallel to the underside of said drawing board, the bracket bearing sleeve being slidably mounted on said guide and including a flange extending perpendicularly from the guide in a direction away from the underside of the drawing board, the closed rectangular frame being mounted in the flange of the socket bearing sleeve.

8. A device according to claim 7 wherein the bracket means includes two guides, and wherein each guide has a bracket bearing sleeve slidably mounted thereon, said bracket bearing sleeves being connected together by at least one stay for maintaining the bracket bearing sleeves opposite each other during parallel displacement along the guides.

* * * * *